United States Patent [19]

Fabbro

[11] Patent Number: 4,633,922

[45] Date of Patent: Jan. 6, 1987

[54] CAP-, DROPPER- AND RING ASSEMBLY FOR BOTTLES

[75] Inventor: Oreste Fabbro, Lancshire, England

[73] Assignee: Rory Ltd., Sorengo, Switzerland

[21] Appl. No.: 755,437

[22] Filed: Jul. 16, 1985

[30] Foreign Application Priority Data

Jul. 16, 1984 [CH] Switzerland ..... 3462/84
May 15, 1985 [CH] Switzerland ..... 2083/85

[51] Int. Cl.[4] ..... B65D 83/00
[52] U.S. Cl. ..... 141/24
[58] Field of Search ..... 215/228, 256, 274, 277; 141/24

[56] References Cited

U.S. PATENT DOCUMENTS

| | | | |
|---|---|---|---|
| 2,854,003 | 9/1958 | Kirsch | 215/228 X |
| 2,870,797 | 1/1959 | Marchant | 141/24 |
| 2,913,017 | 11/1959 | Robineau | 141/24 |
| 3,881,624 | 5/1975 | Dougherty | 141/24 X |
| 4,032,029 | 6/1977 | Cochrane | 215/256 |
| 4,056,129 | 11/1977 | Weiler et al. | 141/24 |

*Primary Examiner*—Donald F. Norton
*Attorney, Agent, or Firm*—Cushman, Darby & Cushman

[57] ABSTRACT

Assembly comprising a cap, a dropper and a ring wherein the dropper-cap and a ring in which the dropper-cap with guarantee seal is pressed onto the ring from which it cannot be removed except after breakage of the guarantee seal and in which the ring is in turn pressed onto the mouth of the bottle and has a stress raiser which enables it to be mounted on the bottle by automatic filling machines.

3 Claims, 9 Drawing Figures

1
4'
2
9
6
7
4
10
11
6
12
3
15
16
13

CAP-, DROPPER- AND RING ASSEMBLY FOR BOTTLES

The present invention relates to a new cap-, dropper- and ring assembly with a guarantee seal for bottles, especially medicine bottles.

Assemblies consisting of a plastic cap, dropper and ring are known. They have however the drawback of requiring the use of special bottles and filling machines. The most widespread known type requires the use of bottles with a threaded mouth upon which the cap-, dropper- and ring assembly is applied by screwing.

The object of the present invention is a dropper-cap which can be combined with the most economical type of bottle and the one most widely use by the pharmaceutical industry for solutions or freeze-dried substances and which is commonly termed penicillin-type bottle. The cap-, dropper- and ring assembly according to the present invention also has the advantage of being producible from very economical materials and being easy to assemble on penicillin-type bottles by means of ordinary automatic filling machines.

The cap-, dropper- and ring assembly according to the present invention consists of a dropper, a cap with a guarantee seal and a ring and is characterized in that the dropper-cap with guarantee seal is pressed onto the ring from which it cannot be removed except by breaking the guarantee seal and that the ring is in turn pressed onto the mouth of the bottle and has a stress raiser which enables mounting it on the bottle by automatic filling machines. Said stress raiser may be assisted by a second stress raiser which is created in the lower internal part of the ring.

An example of a practical embodiment of the cap-, dropper- and ring assembly according to the present invention is illustrated in the annexed drawings wherein.

Figure 4:
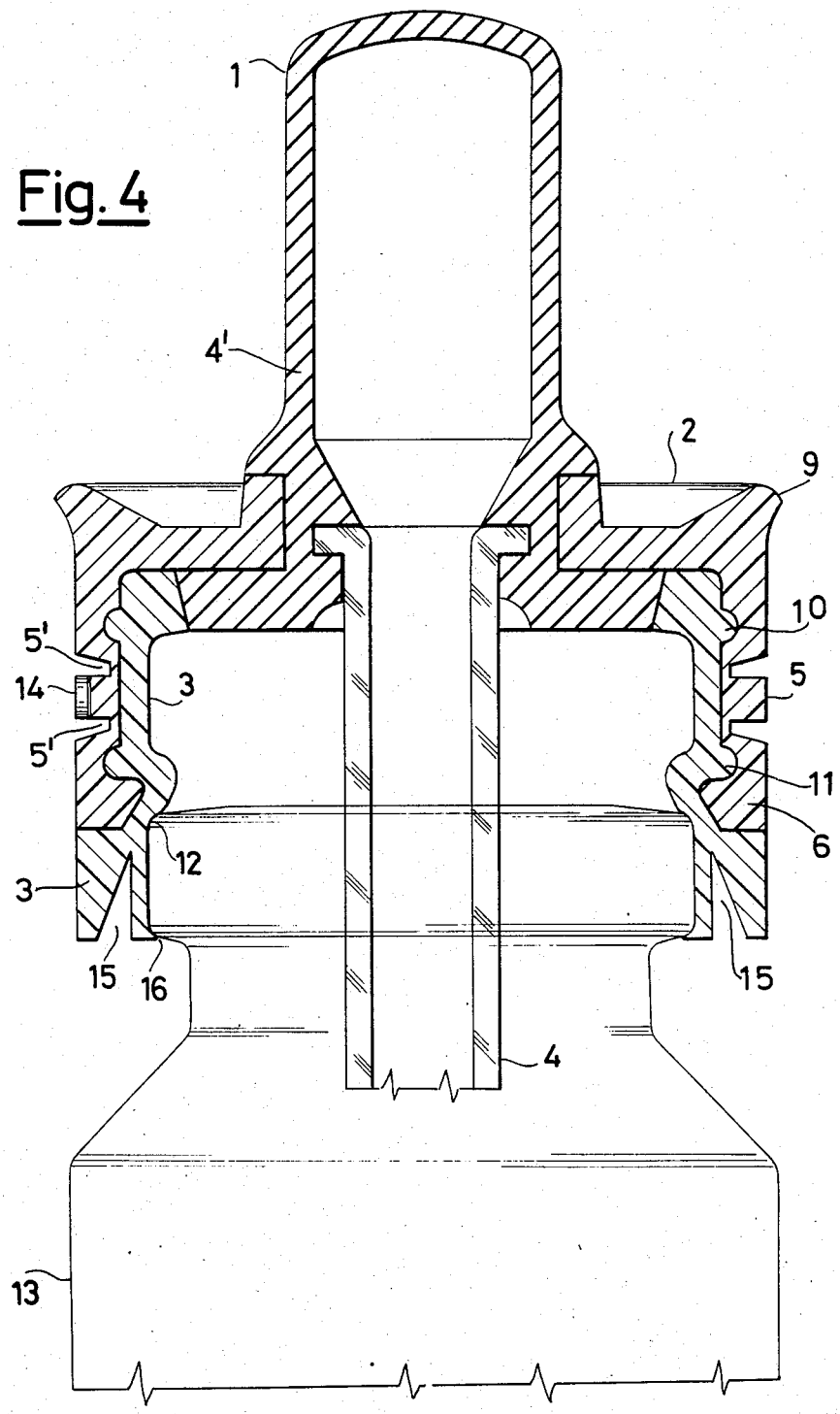
Figure 5:
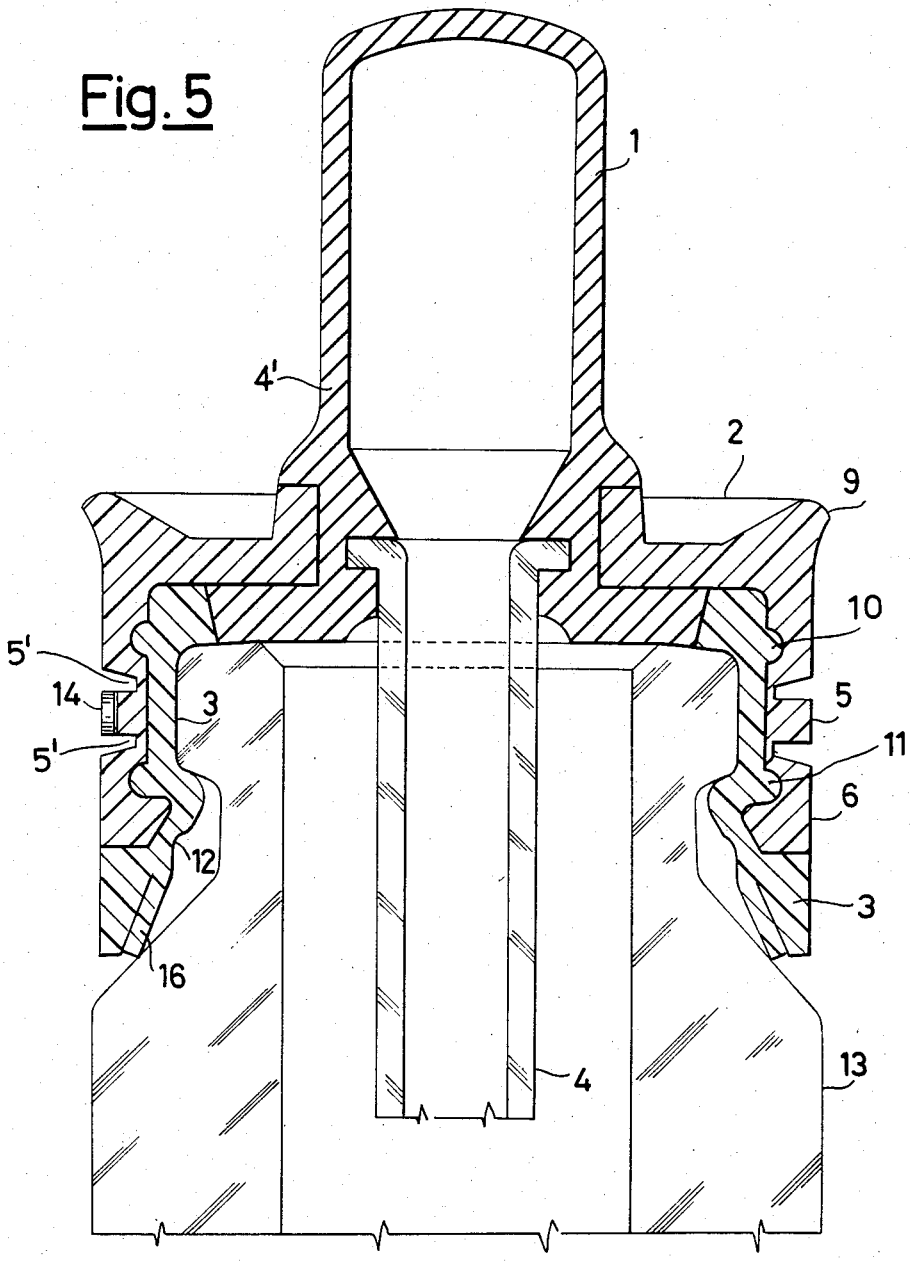
Figure 6:
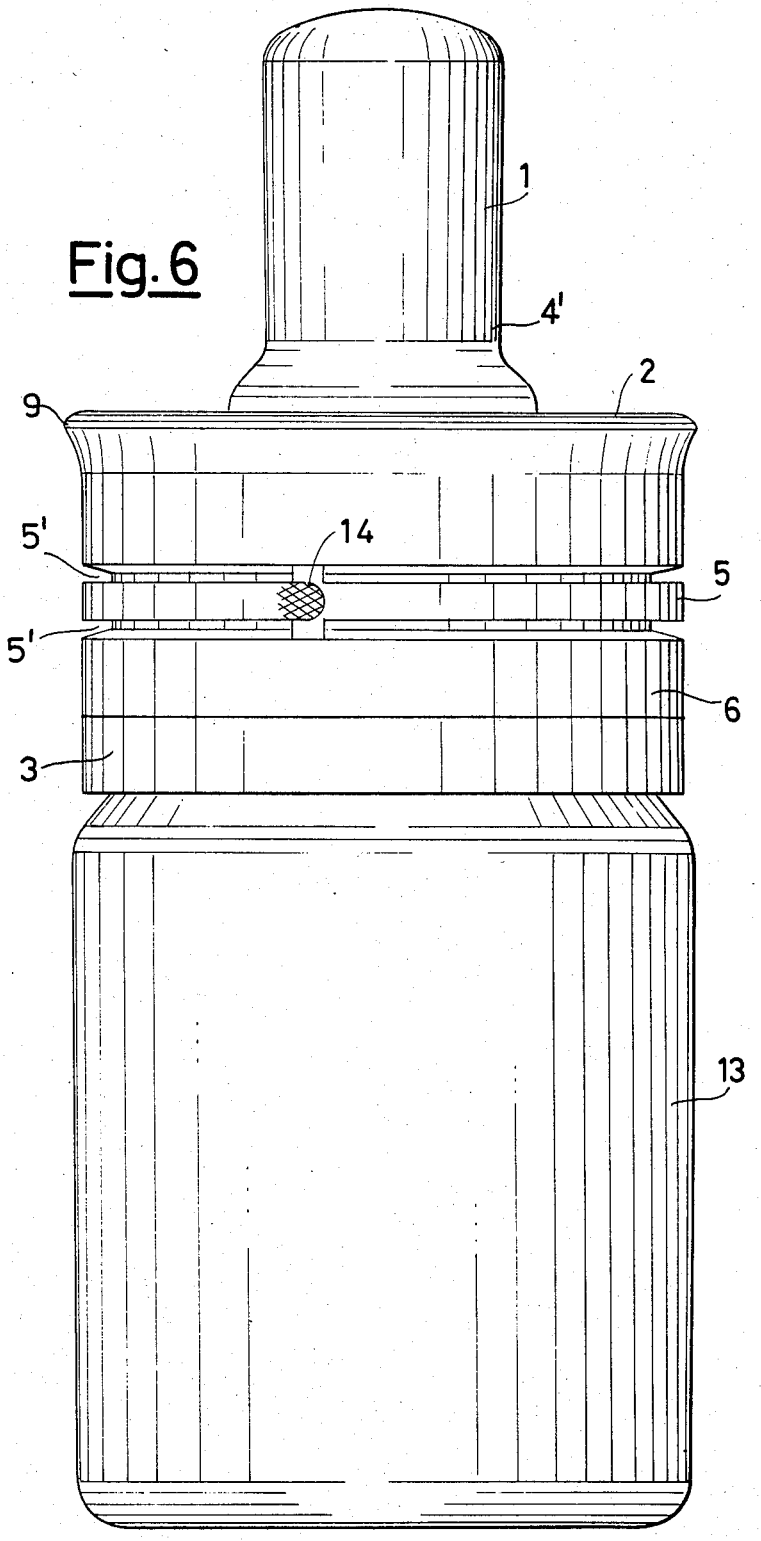

FIG. 4 is a sectional side view of the dropper- 1, cap- 2 and ring 3 assembly when it is held steadily on the bottle 13 by the stress raisers 12, 16 but is not yet mounted in its final position on the bottle;

FIG. 5 is a sectional side view of the dropper- 1, cap- 2 and ring 3 assembly mounted in its final position on the bottle 13;

FIG. 6 corresponds to FIG. 5 except that the dropper- 1, cap- 2 and ring 3 assembly mounted on the bottle 13 is not shown in section.

Figure 7:
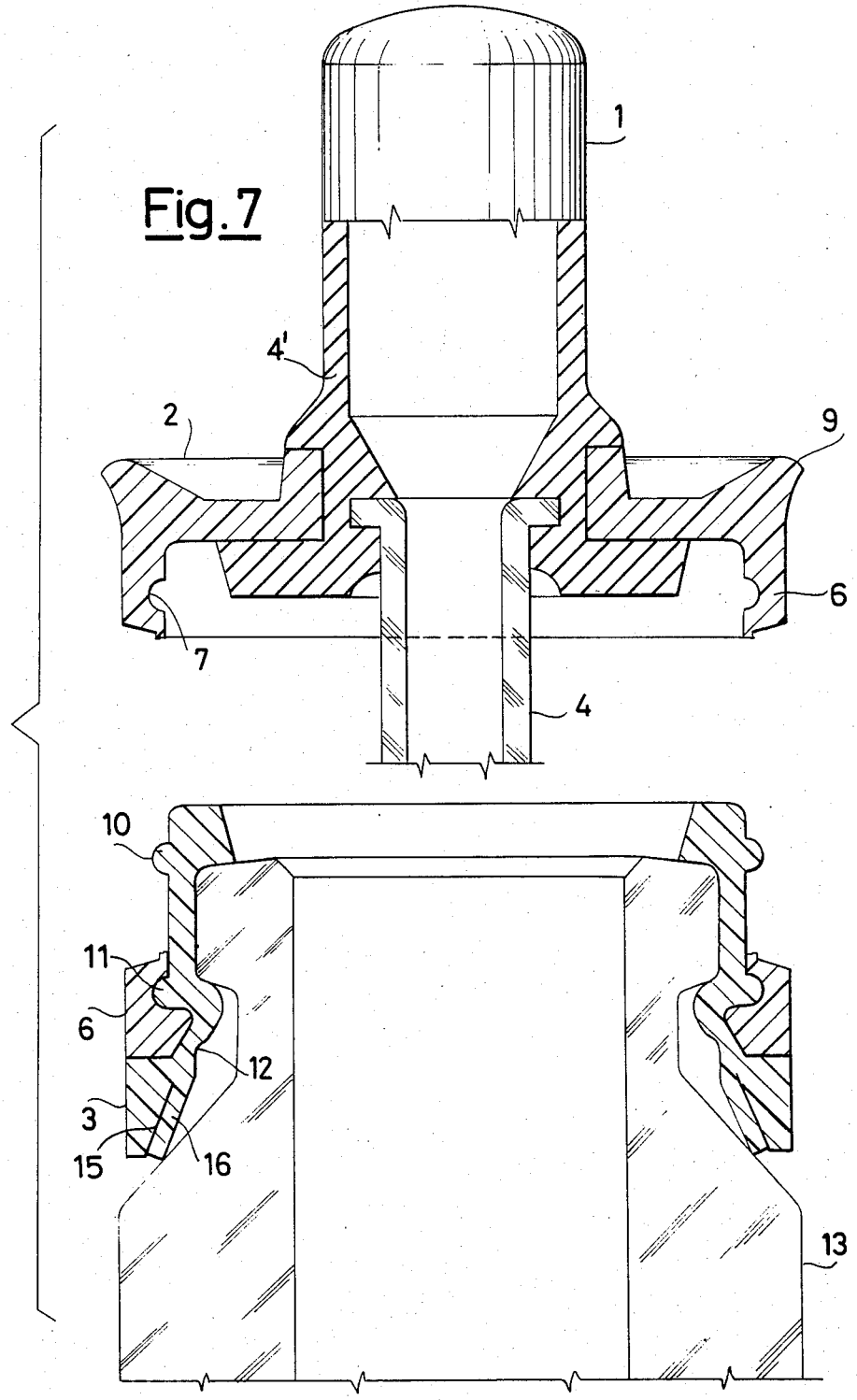
Figure 8:
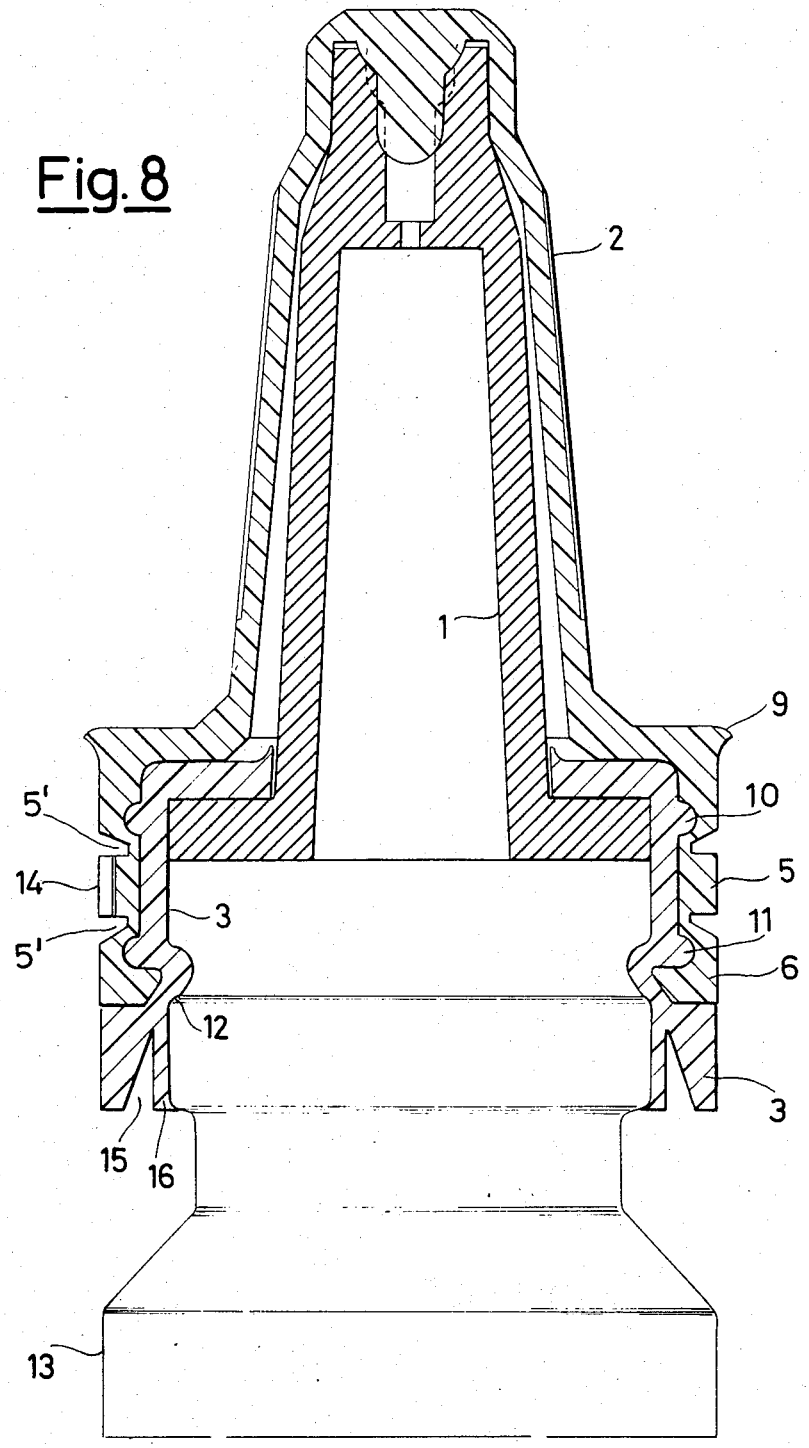
Figure 9:
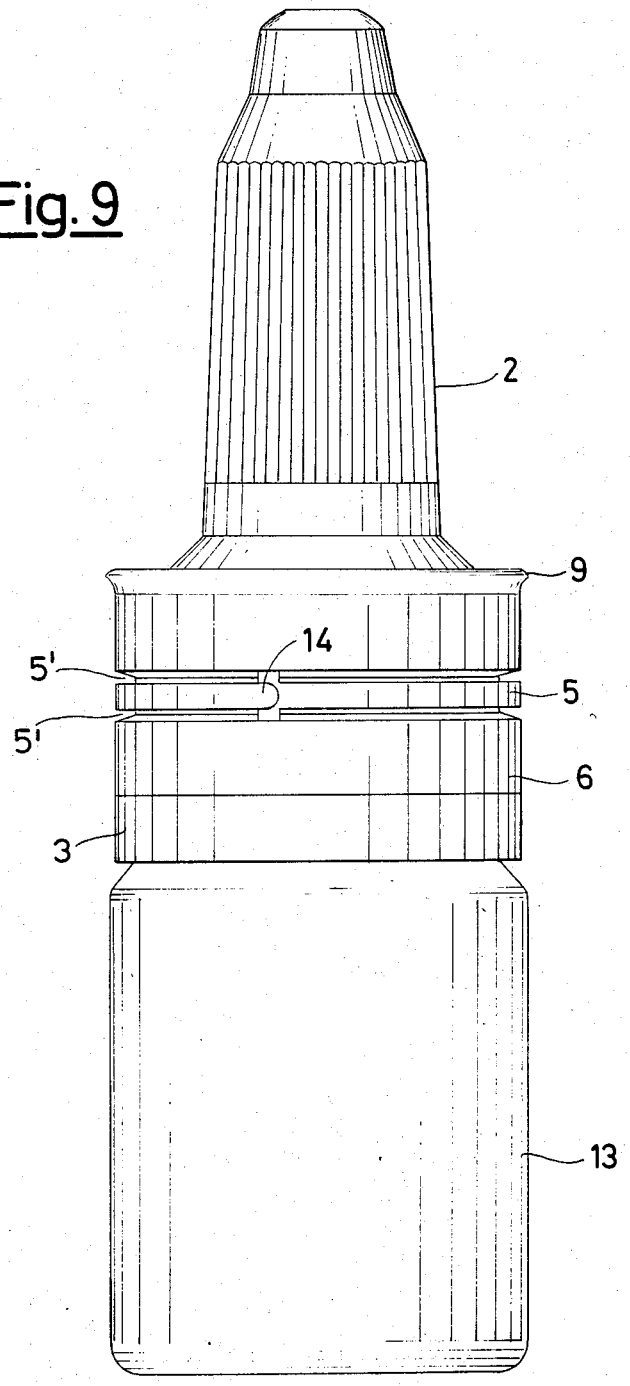

FIG. 7 is a sectional side view showing the dropper-cap 1, 2 after breakage of the guarantee seal;

FIG. 8 which is similar to FIG. 4 illustrates a second type of dropper;

FIG. 9 which is similar to FIG. 6 is a side view of the dropper- 1, cap- 2 and ring 3 assembly of the type illustrated in FIG. 8.

Figure 1:
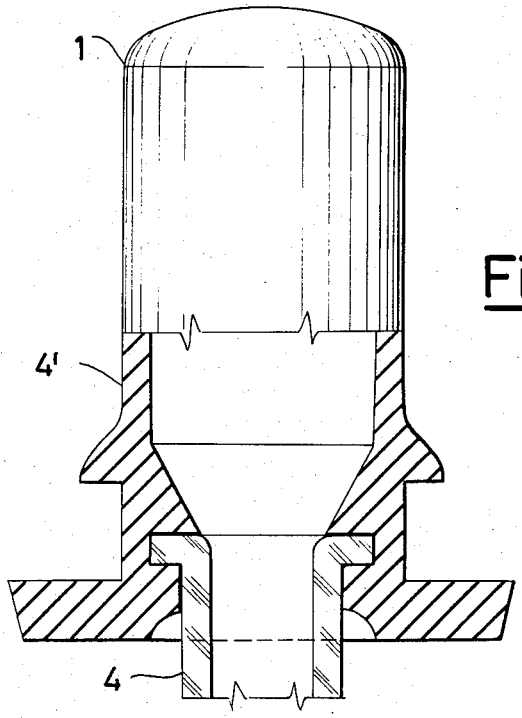
FIG. 1 is a side view of the dropper 1 of the type with a glass stem and rubber pump, the lower part of the dropper being shown in section.

As can be seen in FIG. 1, the stem 4 is incorporated in the pump 4' which is preferably made of a flexible material such as natural rubber while the stem 4 is made of a rather rigid or completely rigid material such as glass and which is compatible with the drugs.

Figure 2:
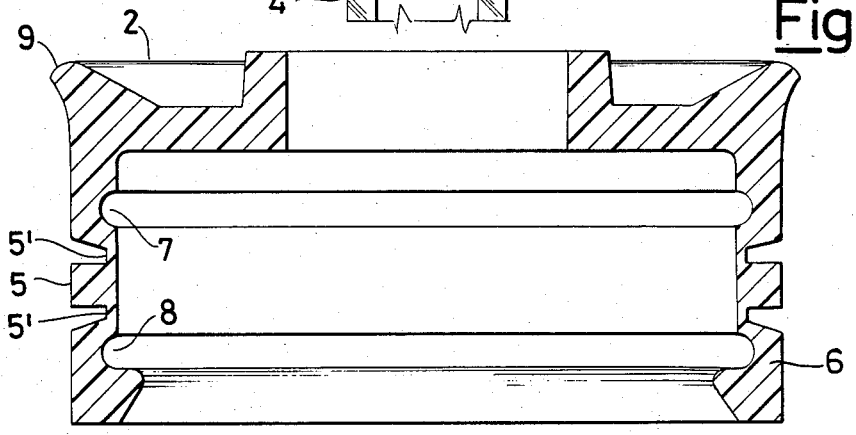
FIG. 2 is a sectional side view of the cap 2.

FIG. 2 shows that the cap 2 has in its external central part a strip 5 which may be torn by pulling along two weakening lines 5' and which thus acts as a guarantee seal. It is also seen that it has in its external upper part a protrusion or collar 9 while on the inside it has two grooves 7, 8.

Figure 3:
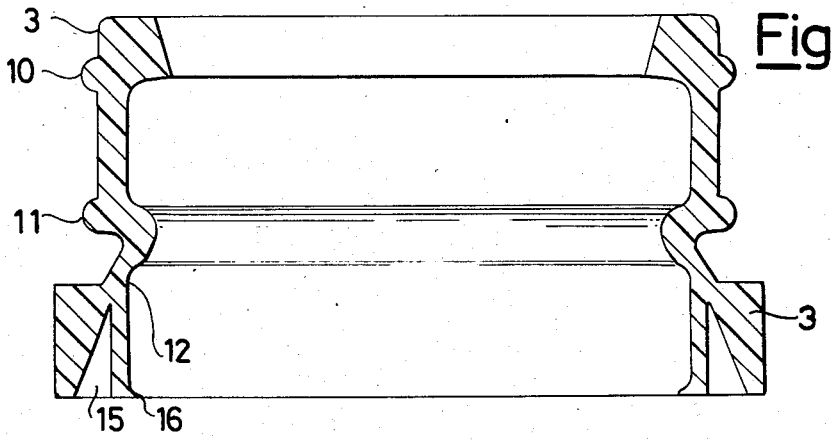
FIG. 3 is a sectional side view of the ring 3.

FIG. 3 shows the ring 3 which has two external ridges 10, 11 designed to fit into the grooves 7, 8 of the cap while it has an internal tapered portion 12. In the lower part of the ring is a recess 15 which gives flexiblity and mobility to the internal part 16 and which may be in the form of an unbroken circle or is preferably broken to form tabs.

The cap 2 and the ring 3 are made preferably of a polymer material such as polyethylene or polypropylene.

Assembly of the unit is very simple; it is sufficient to insert the dropper 1 in the cap 2 from below and then to insert the cap 2 in the ring 3 from above, while exerting a certain amount of pressure thereon. The assembly thus obtained is illustrated in FIGS. 4, 5, 6, 8 and 9.

The chief purpose of FIGS. 4 and 8 is to illustrate the function of the stress raiser 12 and of the internal part 16 of the ring. Automatic filling machines used in association with bottles have a certain number of stations of which two are used for installation of the cap and ring assembly. In the first station the cap and ring assembly is positioned on the mouth of the bottle and in the second station it is secured to the mouth of the bottle with various procedures and equipment depending on the construction and operative features of the cap and ring assembly which is being installed. In its movement from one station to the other the bottle travels on a conveyor belt which imparts to it oscillations which tend to cause the cap and ring assembly to fall if it does not stand steadily enough on the mouth of the bottle.

FIGS. 4 and 8 show how the dropper-, cap- and ring assembly according to the present invention rests steadily on the bottle during travel of said bottle on the conveyor belt between the positioning station and the securing station.

FIGS. 4 and 8 show the presence on the strip 5 of a tongue 14 which facilitates grasping for pulling the strip 5, which acts as a guarantee seal.

FIGS. 5, 6 and 9 show the final installation of the dropper-, cap- and ring assembly after it has been fitted by pressure on the bottle 13. FIG. 5 also shows how the flexibility of the part 16 allows it to bend when it comes in contact with the convex wall of the bottle.

To detach the cap for the first use of the medicine contained therein it is sufficient to grasp the tongue 14, remove the seal 5 and exert with the finger a slight upward pressure on the protrusion 9. The result of this operation is illustrated in FIG. 7.

After use it is sufficient to exert a certain pressure on the cap so that the ridge 10 catches again in the groove 7 for the cap to again be secured to the bottle.

FIG. 8 differs from FIG. 4 essentially by the type and form of the dropper 1 used. The dropper, which is made of rubber, is of a known type. The form of the cap 2 thus varies depending on the different form of the dropper but all the other construction characteristics of the cap-, dropper- and ring assembly correspond to those already illustrated above in FIGS. 1 to 7.

Various other embodiments may be accomplished without departing from the inventive idea illustrated above.

I claim:

1. Cap- (2), dropper- (1) and ring (3) assembly for penicillin-type bottles comprising a dropper (1), a cap (2) with a guarantee seal (5) and a ring (3) characterized in that the cap (2) and dropper (1) with guarantee seal (5) are mounted together on the ring by pressure (3) from which they cannot be removed except after breakage of the guarantee seal (5) and in that the ring (3) in turn can be pressed onto the mouth of a bottle and has a tapered portion (12) which enables it to be mounted on a bottle by automatic filling machines.

2. Cap- (2), dropper- (1) and ring (3) assembly according to claim 1 characterized in that in the lower part of the ring (3) is a recess (15) which gives flexibility and mobility to an internal part (16).

3. Cap- (2), dropper- (1) and ring (3) assembly according to claim 1 characterized in that the cap (2) has a collar (9).

* * * * *